US009446897B2

(12) United States Patent
Schinasi et al.

(10) Patent No.: US 9,446,897 B2
(45) Date of Patent: Sep. 20, 2016

(54) BAG FOR TRANSPORTING AND HANDLING LIQUID OR QUASI LIQUID SUBSTANCES

(75) Inventors: Piero Schinasi, Epelinges (CH); Stéphane Levy, Lausanne (CH)

(73) Assignee: Codefine S.A., Lausanne (CH)

( * ) Notice: Subject to any disclaimer, the term of this patent is extended or adjusted under 35 U.S.C. 154(b) by 578 days.

(21) Appl. No.: 12/452,709

(22) PCT Filed: Jul. 16, 2008

(86) PCT No.: PCT/IB2008/052852

§ 371 (c)(1),
(2), (4) Date: Jan. 19, 2010

(87) PCT Pub. No.: WO2009/010928

PCT Pub. Date: Jan. 22, 2009

(65) Prior Publication Data

US 2010/0119179 A1 May 13, 2010

(30) Foreign Application Priority Data

Jul. 16, 2007 (CH) ..... 1147/07

(51) Int. Cl.
*B65D 88/16* (2006.01)

(52) U.S. Cl.
CPC ..... *B65D 88/1687* (2013.01); *B65D 88/16* (2013.01); *B65D 88/1625* (2013.01); *B65D 88/1656* (2013.01); *B65D 88/1675* (2013.01); *B65D 88/1681* (2013.01)

(58) Field of Classification Search
CPC ..... B65D 88/16; B65D 88/1606; B65D 88/1612; B65D 88/1618; B65D 88/1625; B65D 88/1631; B65D 88/1637; B65D 88/1643; B65D 88/1668; B65D 88/1675; B65D 88/1681; B65D 88/1687; B65D 88/26; B65D 88/28
USPC ..... 383/6, 17, 19, 20, 119, 121, 121.1, 24
See application file for complete search history.

(56) References Cited

U.S. PATENT DOCUMENTS 3,036,752 A * 5/1962 Elliott ..... 206/386
4,301,848 A * 11/1981 Beaven et al. ..... 383/20

(Continued)

FOREIGN PATENT DOCUMENTS

CH 698245 B1 * 6/2009 ..... B65D 88/16
EP 1023232 B1 5/2001

(Continued)

OTHER PUBLICATIONS

WO9854070Translation.*

*Primary Examiner* — Jes F Pascua
*Assistant Examiner* — Nina Attel
(74) *Attorney, Agent, or Firm* — Taft Stettinius & Hollister LLP

(57) ABSTRACT

The invention relates to a bag for transporting and handling liquid or quasi liquid substances, that comprises at least a bottom and four sides and optionally a lid. The bag is provided with a sealed inner envelope including filling and optionally draining members. The bag also includes reinforcement plates integrated in the sides and the lid of the bag and optionally in the bottom of the bag. The bag is further provided with members for lifting same. The bag is particularly characterised in that the four sides of the bag include at the upper portions thereof an overhanging collar (2) oriented towards the inside, the four tails of the collar being connected at their adjacent edges along common ridges (3) oriented as in a pyramid, and in that the lifting members include, on the one hand, lifting straps (7) including a section (7*d*) sawn on the above-mentioned ridges (3) of the collar so that each strap, also sawn on the vertical ridges of the four corners of the bag (7*a*), includes a section (7*d*) oriented back into the bag along said ridge (3) and, on the other hand, a tube or duct (8) connected at least to the straps grouped by pairs.

12 Claims, 5 Drawing Sheets

(56) References Cited

U.S. PATENT DOCUMENTS

| | | | | | |
|---|---|---|---|---|---|
| 4,759,473 | A | * | 7/1988 | Derby et al. | 222/105 |
| 5,340,217 | A | * | 8/1994 | Rothman | 383/17 |
| 5,865,540 | A | * | 2/1999 | Derby et al. | 383/24 |
| 6,015,057 | A | * | 1/2000 | Stone et al. | 220/9.2 |

FOREIGN PATENT DOCUMENTS

| | | | | | |
|---|---|---|---|---|---|
| GB | 2420337 | A | | 5/2005 | |
| WO | WO 97/20758 | | | 6/1997 | |
| WO | WO 9854070 | A1 | * | 12/1998 | B65D 88/16 |

* cited by examiner

BAG FOR TRANSPORTING AND HANDLING LIQUID OR QUASI LIQUID SUBSTANCES

This application claims the benefits under 35 U.S.C. 119(a)-(d) or (b), or 365(b) of International Application No. PCT/IB2008/052852 filed 16 Jul. 2008, and Swiss Patent Application No. 01147/07 filed 16 Jul. 2007.

The present invention relates to a bag for transporting and handling liquid or quasi liquid substances. It more particularly relates to a bag, generally classified as a "big bag" in the industrial and transportation fields, i.e. bags making it possible to transport a volume of a product of the order of one cubic meter, or even more, which may lead to a weight of two tons or more.

The bags in this category are generally made of the assembly of cloth pieces, ordinarily made of polypropylene, an assembly which devices intended to provide lifting thereof, essentially lifting straps also made of a woven or braided synthetic material, can be added to.

The particularity of the bags mentioned in relation with the present invention is that, in addition to the cloth pieces and the lifting straps, sealing inner envelopes, or "liners", provided with filling and draining devices, or ports provided with valves, are implemented. The types of products that bags of this type are intended to transport can vary from water to apple sauce, and any type of more or less liquid product that you can think of.

The persons skilled in the concerned art know exactly how to produce large size bags to contain such liquids in the broad sense. A construction with a double cloth so as to incorporate therein reinforcement and strengtheners is known, as is known from document U.S. Pat. No. 6,015,057 that lifting straps, can be positioned in the four corners of the bag in order to transport and/or handle it when it is hanging from a machinery.

All this is known, and it is also known that it would be more appropriate to do it, however nobody does it because everybody faces the same problem.

Everyone intuitively realises that, in order to carry a bucket of water, it is better (it is more practical, more stable and surer) to take it by the handle in suspension, than to carry it bottomside and lift the bottom thereof.

This acknowledgement is and has always been valid for the bag intended to transport liquids. There is no particular problem in making a bag with a view to handling it using a crane, more particularly if the latter is provided with a lifting cross cooperating with four lifting straps positioned at the four corners of the bag.

However, modern transport is carried out in containers of 20 or 40 feet, which prevents any loading with a crane. These containers are loaded using forklift trucks, which results in the fact that the bags intended to transport liquids are positioned on pallets, and carried bottomside, even though everyone knows that this is not the best way to carry the same.

It should be noted that document EP 1023232 is largely responsible for the suppression of pallets as far as the transportation of goods such as sand, corn, bricks or potatoes is concerned.

There is of course a redhibitory reason which explains why this is not done, whereas economical and technical need therefor is known, and whereas everybody intuitively knows that it should be done.

The reason can be explained as follows. If the bag filled with liquid is hanging from the forks of a forklift truck and if the driver must intensely brake, without mentioning the case of an emergency stop, a disaster may occur. As a matter of fact, although it is not necessary to explain what happens inside the bag from a scientific point of view, it can be seen, from the outside, that the bag amplifies the motion resulting from the acceleration with some kind of an inner wave, that it swings up, then it slips on the back straps and goes forwards on the fork of the forklift truck until the front straps are released and it is held only by the back straps, which are then close to the middle of the fork. The bag cannot bear such forces, it brakes and releases the content thereof on the ground. This problem could be remedied by using forks having an oversize length, but this does not make much sense since, when the bags must be loaded into a container, the front straps must compulsorily be positioned as close as possible to the free end of the fork.

It should be underlined here that the teaching of document EP 1023232 remains valid for the aim desired, but that such teaching is incapable of solving the above-mentioned problem of the tilting wave, with the result described hereabove being almost the same.

The object of the present invention is to propose a bag intended for transporting liquids, the construction particularities of which make it possible to damp the wave motion caused by the braking or the stopping of the forklift truck, and to neutralise as much as possible the consequences that this wave effect, even though attenuated, may have, and thus make compatible with the industrial scale the transportation of bags for liquid by hanging these from the forks of a forklift truck and thus release said transportation from the constraints and disadvantages connected to the usage of pallets.

For this purpose, the present invention relates to a bag for transporting and handling liquid or quasi liquid substances that comprises at least a bottom and four sides and optionally a lid, the bag being provided with a sealed inner envelope including filling and optionally draining members and being also provided with reinforcement plates integrated in the sides and optionally in the lid of the bags and being also provided with members for lifting the same, characterised in that the four sides of the bag include at the upper parts thereof an overhanging collar oriented towards the inside, the four tails of the collar being connected at their adjacent edges along common ridges oriented as in a pyramid, and in that the lifting members include on the one hand lifting straps including a section sawn on the above-mentioned ridges of the collar, so that each strap also sawn on the vertical ridge of the four corners of the bag includes a section oriented back into the bag along said ridge, and on the other hand a tube or duct connected at least to the straps grouped by pairs and the free end of each strap having a different lengths. The bag may further be provided with one reinforcement plate integrated in the bottom thereof. Other particularities of the bag according to the invention are characterised in the text of the pages entitled "claims" which is supposed to be integrally referenced herein.

In the description of the patent, this part of the statement describes the embodiments of the invention, which will be done. hereinafter, but in this case, the applicant has decided to have the description of the state of the art and of the problem to be solved immediately followed by what is the essence of the solution hereinunder.

As far as transporting a bag using a forklift truck is concerned, the teaching of the document EP 1023232 cannot be ignored and it is not. This teaching is thus applied in a transposed way, but three additional roles for which it was not designed could be added through judicious construction particularities. First, by integrating the lifting straps differently, the two horizontal tubes in which the fork can engage without any assistance will not be positioned on the sides of the bag but, on the contrary, on the upper face thereof, which results in the fork opposing any movement for lifting the bag in case of a wave effect. The amplitude of this movement is thus limited by this stopper embodied by the lower face of the arms of the fork. Second and still thanks to the same modified integration of the straps, a preformed side component is introduced in the loop formed by each strap, which thus has a "flat part" which is passed on to the cloth forming the tube. This flat part of the tube favours a horizontal braking effect when the front straps disengage and also makes it possible not to let the bag hang by the back straps alone in this assumption. Third and still using the same lay-out modification which gives an oblique connection (and not a perpendicular one) between such lifting straps and the arms of the fork, a freezing effect is induced which also opposes the possible displacement of the bag along the fork further to the braking and thus gives a better holding in case of a sudden movement or a short turn.

Hereinunder are described the particularities and alternatives of the bag according to the invention while referring to the drawings wherein.

Figure 1:
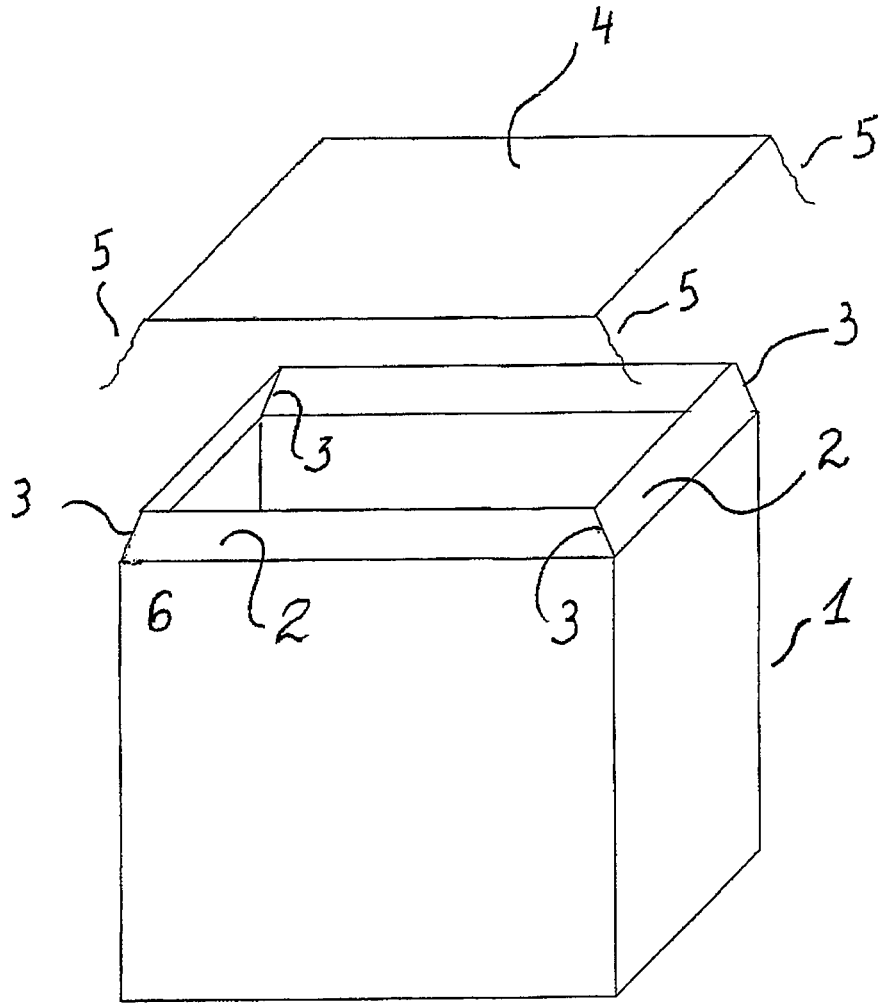
FIG. 1 shows a perspective view of the basic element of the bag according to the invention.

FIG. 1 shows the bag 1 which is illustrated here in a substantially cubic shape which is not a limitation. An overhanging collar 2 oriented towards the inside of the bag can immediately be seen at the upper part of the bag. This collar is formed by extensions of the cloth pieces forming the sides of the bag, said extensions being sawn together along the ridges 3 of the collar. The four ridges 3 are positioned on straight lines which would intersect at the same point and form a pyramid if they were extended upwards.

Finally a piece of cloth used as a lid 4 can be recognised, which will be further connected to the bag using the strands 5.

Figure 2:
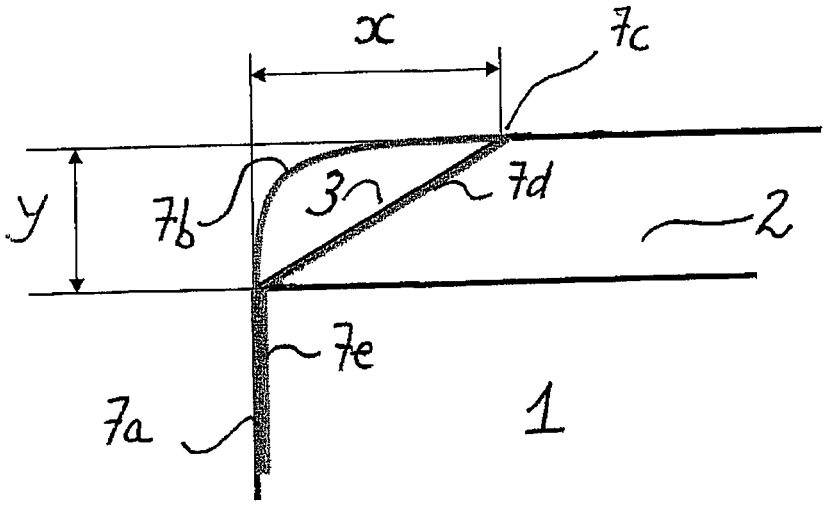
FIG. 2 shows a perspective view of a detail of the bag according to the invention, which detail corresponds to the left upper corner of the drawing in FIG. 1, as identified on FIG. 1 by the reference 6.

In FIG. 2, the upper part of the bag 1, as well as a section of the collar 2 and finally one of the oblique ridges 3 can be seen. The oblique characteristic of the ridge 3 is determined by the horizontal component x, which represents the depth of the overhanging that the collar 2 makes, as well as by the vertical component y which gives the inclination of the pyramid formed by the four ridges 3 together.

In the preferred version, the collar 2 and the positioning of the ridges 3 will be determined by a ratio of three to two between the component x and the component y ($2x=3y$). The exact position on the four ridges 3 being thus determined, the layout of the lifting straps 7 can be described in detail. The lifting strap is of course made of one piece in a woven or braided material, but for the simplicity of the statement, four sections respectively identified by the reference numbers 7*a*, 7*b*, 7*d* and 7*e* as well as a particular point identified by the reference 7*c* have been distinguished.

In the section 7*a*, the lifting strap is sawn along the vertical ridge formed by two adjacent sides of the bag. Then, the lifting strap has a free section 7*b*, the shape of which is, at least in theory, at rest is close to that of a parabola rather than the usual form of an oblong loop. Of course, when the bag is filled with one or several tons of product and it is lifted by the fork of a forklift truck, some relative positions will change but the free loop 7*b* will, in the constructive condition, end at the highest point 7*c* thereof, since the strap is then sawn on the oblique ridge 3 according to the section 7*d*. Then, up to the end thereof, the strap is again sawn on vertical ridge of the bag according to the section 7*e*. The free section 7*b* is longer than the sawn section 7*d* and this different length to be optimised in each particular case favours a trend of the loop formed by the strap to remain open and thus to favour an easy engagement of the fork of the forklift truck.

The four upper corners of the bag 1 are provided with a lifting strap 7 absolutely similar to that described in FIG. 2 so that the bag is perfectly symmetrical as a whole.

Figure 3:
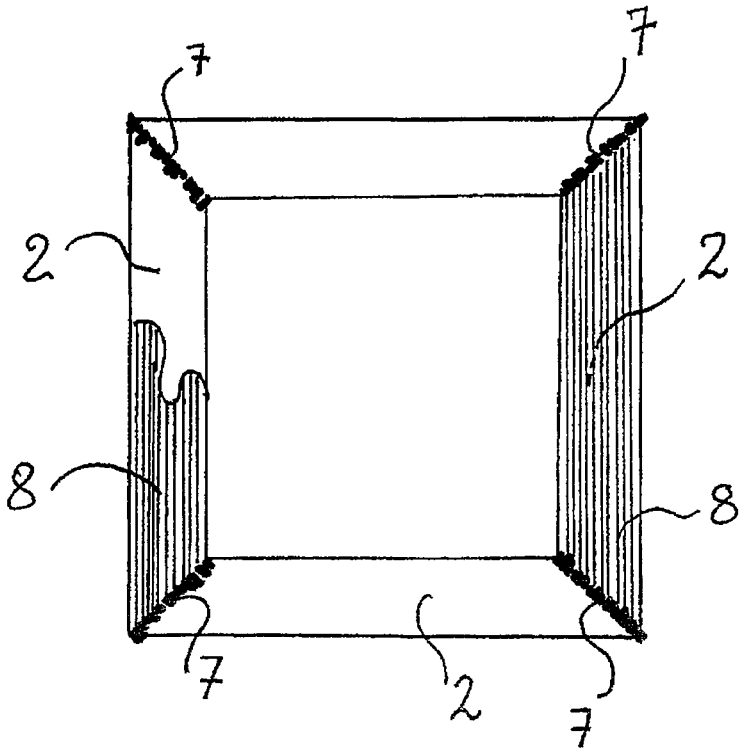
FIG. 3 shows a top view of the bag according to the invention.

In FIG. 3 which shows a top view of the bag, the lifting straps 7 can be seen at the four upper corners of the bag and they are positioned according to the oblique ridge which is the jointing of the internally overhanging collars 2.

A connection is also to be seen and it is provided by a piece of cloth 8 sawn on each of the two straps forming a pair. The piece of cloth 8 thus forms, with both lifting straps 7 of the same pair a tube or a duct intended to favour the engagement of the arms of the fork of an elevating truck.

Although not shown in FIG. 3, it can be understood that when the forklift truck engages the fork into both tubes, or ducts 8, the lifting straps 7 will not be perpendicular to the axis of engagement of the arm of the fork, but on the contrary, they will be oblique with respect to this axis.

The result in this particularity is that in case of braking or sudden stopping of the forklift truck, the oblique component of the lifting straps will tend to increase and thus generate a freezing and resisting effect opposing to the disengagement of the fork. The same is true in case of a sudden motion or a short turn.

Figure 4:
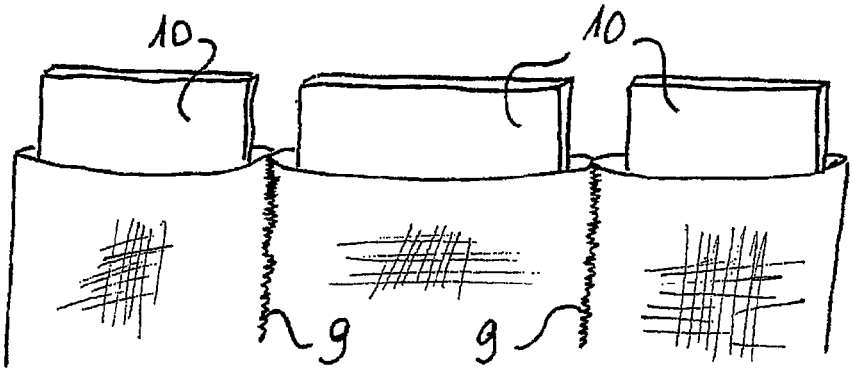
FIG. 4 shows a perspective detailed view of one side of the bag according to the invention.
Figure 5:
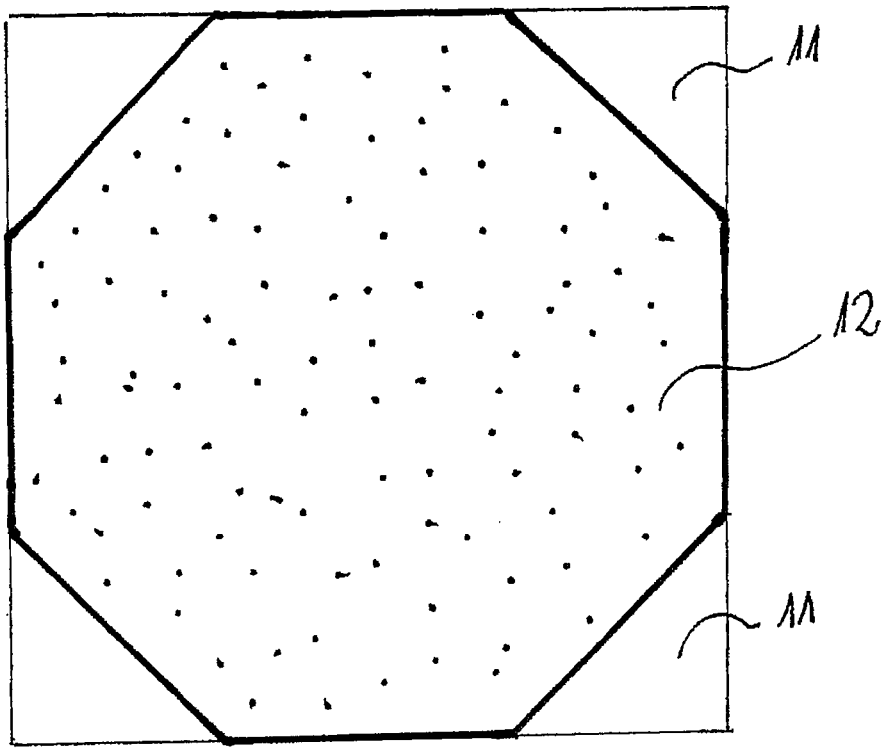
FIG. 5 shows a top view of the bottom of the bag according to the invention.

In FIG. 4, one of the four sides of the bag according to the invention can be seen. It can be noted that the sides as well as the bottom of the bag are made of a double layer cloth. This double cloth can be made either by joining two parts of a simple cloth or by using a tubular cloth folded in two, thus forming a flat sock. In any case, it is known that to produce bags intended to contain liquids, it is necessary to integrate reinforcements and strengthening parts. As a matter of fact, the double cloth on the sides of the bag is divided into three lodging parts by making two vertical stitches 9 which will run on the whole height of the bag. Inside the three thus formed lodging parts, reinforcing plates 10 are introduced. Of course, the reinforcing plates are completely inside the three parts, whereas on the Figure they are shown slightly out, so that they can be seen. There is nothing revolutionary in this well-known construction type, however a particularity can be noted in the embodiment shown, i.e. the central lodging part is bigger than both side lodging parts. The width of the central reinforcement plate is approximately 30% larger than the width of both side plates; the height of the three plates is of course the same. This ratio between the various reinforcement plates 10 and consequently the various parts thus created in the vertical sides of the bag by the stitches 9 is particularly adapted to facilitate the sewing of the cloth straps 13, thus described hereinafter in relation with FIG. 6, along the same stitching lines separating the reinforcement plates 10. This configuration also makes it possible, if so required, to introduce a reinforcement having an octagonal shape into the bottom of the bag, as shown in FIG. 5. The lid 4, as illustrated in FIG. 1, can also be made in a double cloth and thus include between the two pieces of cloth a reinforcement plate with a view to facilitate the stacking.

In FIG. 5, the double cloth can be seen in the four corners as constituting the bottom of the bag 11 on which the optional octagonal reinforcing plate 12 is positioned.

Figure 6:
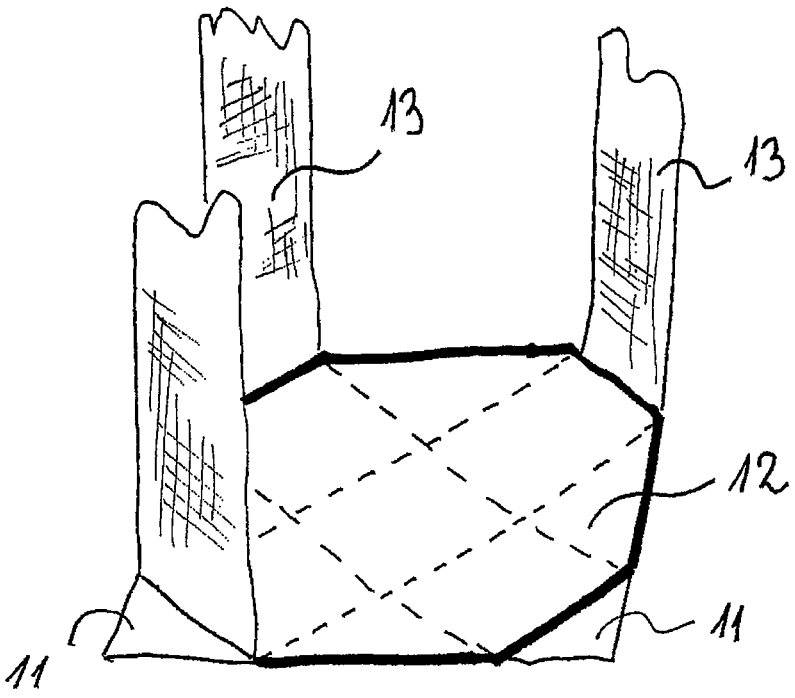
FIG. 6 shows a schematic and partial perspective view of the bottom of the bag according to the invention and some arrangements of internal vertical sides.

In FIG. 6, the plate reinforcing the bottom 12 can be seen and two cloth straps 13 going up the whole height of the bag and integral with the four sides of the bag thanks to the stitching line mentioned with the reference number 9 in FIG. 4. The two cloth straps 13 intersect on the bottom and form an "X".

When the liner is filled with the liquid to be transported, it will rest on the cloth straps 13 which will act on the stitches 9 and pull these towards the inside of the bag, which will make it possible to oppose the natural trend of the four sides of the filled bag to bulge towards the outside. Thus a square section thereof will be more easily kept on the whole height of the bag.

Figure 7:
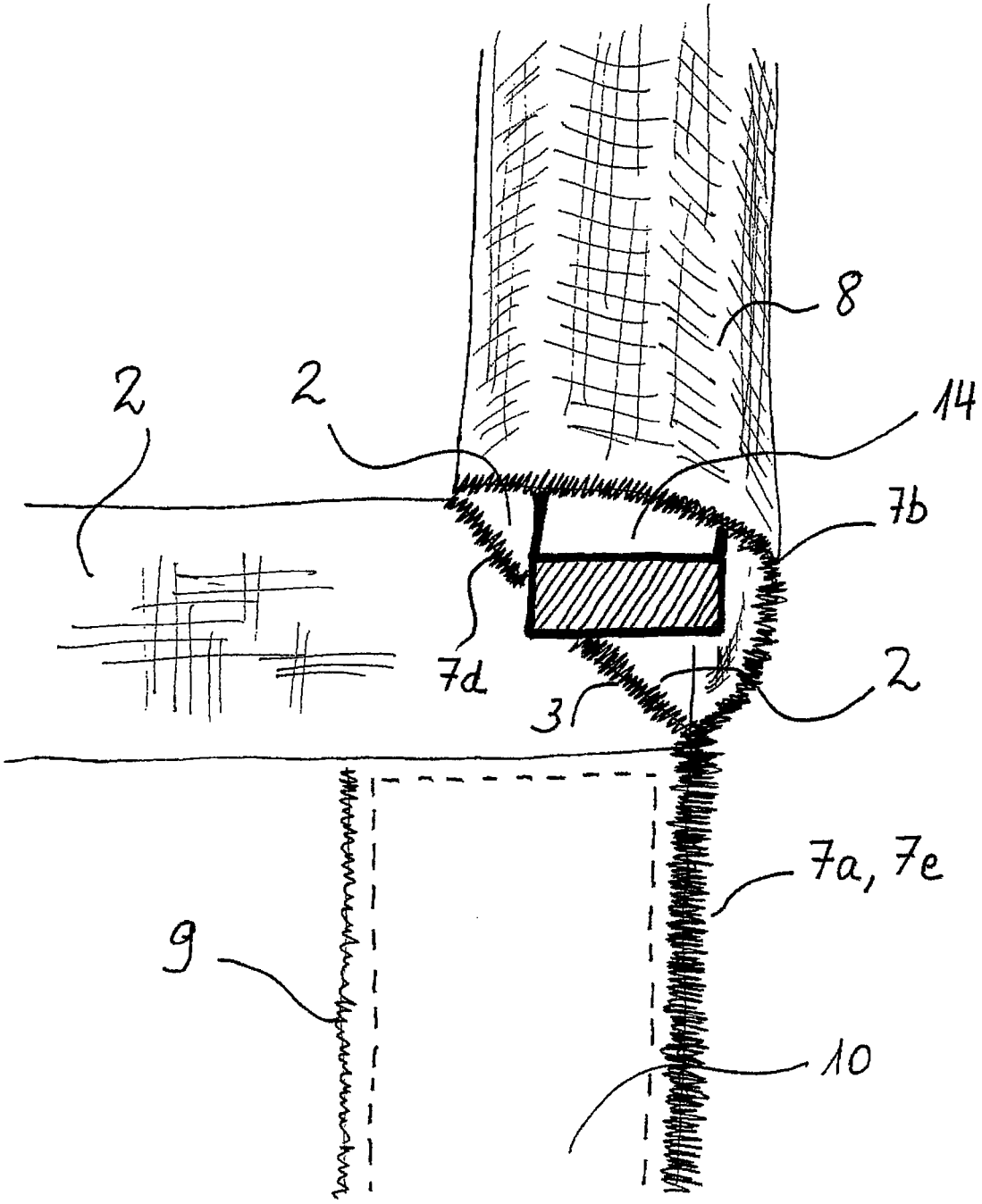
FIG. 7 shows a detailed perspective view of an upper corner of the bag according to the invention, i.e. the right upper proximal corner.

In FIG. 7, a truncated representation of one of the arms 14 of the fork of a forklift truck can be seen, when the arm is engaged in the tube or duct 8 just prior to the forklift truck lifting the bag.

One of the four lifting straps 7 and the various sections of such strap such as described, while referring to FIGS. 2 (7*a*, 7*e*, 7*b* and 7*d*), can be seen.

Two tails of the overhanging collar 2 joined by the ridge 3 can also be seen. Finally, the vertical stitch 9 can be seen, which forms the lodging parts for the reinforcement plates 10.

It should be particularly noted here that the side reinforcement plate 10 is underneath (vertically) the arm of the fork of the forklift truck 14, so that if the bag swings up, this will be limited by the abutting effect caused by the reinforcement plate 10 meeting the lower face of the arm of the fork 14.

If FIGS. 5 and 7 are compared, it can be seen that the ridge 3 and consequently the loop of the lifting straps (7*e* and 7*b*) is above an empty vertical column rising from the free corners 11 of the bottom of the bag. This particularity can be added to the stopping effect already mentioned with respect to FIG. 3.

The bag according to the invention makes the use of a forklift truck more secure and practical to raise in suspension (and not carry bottomside) bags filled with liquid.

In the proportions given in the previous description, the thus manufactured bag has an extraordinary handling capacity. As a matter of fact, the lifting straps are remarkably opened under any circumstances, thus making easier the engagement of the fork. In addition, the resistance to the swinging and wave movement of the liquid is proven as well as the increased resistance to the disengagement of the fork in case of a sudden stop. Finally, the position of the construction elements as described, more particularly the addition of an octagonal bottom and angle straps intersecting in an "X" give the bag a perfect behaviour which makes it possible to stack two bags or more with an impressive stability.

When the bag is so constructed that the sides measure approximately 110 centimeters wide (considering the described proportions), the bag according to the invention can easily be loaded into containers, two bags being placed side by side in a row and four bags in a row if they are stacked.

As a conclusion, the loading is made easier thanks to the fact that the tubes surrounded by straps are positioned above the bag and almost do not overhang towards the outside. The forklift truck with a standard fork space of 90 centimeters can handle the bag without anything overhanging to the outside of the 110 centimeters width, as recommended above. And the most impressive thing is that the secure effect, which means the neutralisation of the wave effect and the consequences thereof, also results from the same construction design.

The invention claimed is:

1. A bag for transporting and handling liquid or quasi liquid substances that comprises at least a bottom and four sides, the bag being provided with a sealed inner envelope including filling members and being also provided with reinforcement plates integrated in the sides and being also provided with members for lifting same, wherein the four sides of the bag are connected along adjacent edges to form vertical and oblique ridges at each of four corners of the bag and wherein the bag includes at upper portions thereof an overhanging collar oriented towards an inside, four parts of the collar being connected at their adjacent edges along the oblique ridges oriented as in a pyramid, wherein the lifting members include on the one hand lifting straps including a section sewn on the above-mentioned ridges of the collar and a section free of attachment to the bag, so that each lifting strap also sewn on the vertical ridge of the four corners of the bag has a section oriented back into the bag along said vertical and oblique ridges so as to further extend along interior vertical and oblique ridges, and on the other hand a cloth piece connected at least to the lifting straps grouped by pairs along said free section and said sewn section, said piece of cloth forming with both lifting straps of the same pair a tube or a duct in which the fork of a forklift truck can be engaged, the sewn section and the free section of each lifting strap having different lengths and being in an oblique plane with respect to a horizontal insertion axis of the arms of the fork of the forklift truck in the tubes or ducts, wherein the sewn section and the free section of each lifting strap form a loop that is positioned alongside the collar and wherein two extremities of the free section of each lifting strap are connected to the sewn section thereof at two separate points located on one oblique ridge of the collar.

2. A bag according to claim 1, wherein the inner envelope is provided with draining members.

3. A bag according to claim 1, provided with a reinforcement plate integrated in the bottom thereof.

4. A bag according to claim 3, wherein the reinforcement plate integrated in the bottom of the bag is octagonal.

5. A bag according to claim 1, wherein, because of the section thereof sewn on the ridge, the free section of each lifting strap wherein the fork of a forklift truck can be engaged, and consequently said arm too, is at least partially overhanging the inside of the bag.

6. A bag according to claim 1, wherein two cloth strips forming an "X" by intersecting at the bottom of the bag are sewn on the four sides of the bag.

7. A bag according to claim 6, wherein the sides of the bag include two side reinforcement plates and one central reinforcement plate, wherein the width of the central reinforcement plate is greater of one third to that of the side reinforcement plates and wherein both said cloth strips are sewn on the four sides of the bag according to the same sewing lines which also separate the central reinforcement plate from the side reinforcement plates.

8. A bag according to claim 1, wherein the sides of the bag include two side reinforcement plates and one central reinforcement plate, wherein the width of the central reinforcement plate is greater of one third to that of the side reinforcement plates.

9. A bag according to claim 8, wherein the side reinforcement plates are positioned underneath the arms of the fork of the forklift when said arms are engaged in the tubes or ducts of the bag, thereby limiting the swing of the bag by the abutting effect caused by said side reinforcement plates meeting said arms of the fork.

10. A bag according to claim 1, wherein the two cloth pieces which each form respectively each of both tubes or ducts are also made at least partially integral, by a total or partial sewing, on the side of the bag at the summit of which each of said tubes or ducts runs at least partially inside.

11. A bag according to claim 1, wherein the orientation of the collar is defined by a ratio of three to two between its horizontal component representing the depth of the overhanging that the collar makes and its vertical component.

12. A bag according to claim 1, wherein the shape of the free section of the lifting straps is close to that of a parabola.

* * * * *